US006106448A

United States Patent [19]

Obara et al.

[11] Patent Number: 6,106,448

[45] Date of Patent: Aug. 22, 2000

[54] PACKAGE MATERIAL PROCESSING MACHINE

[75] Inventors: Sho Obara, Koshigaya; Yoshiji Moteki, Kitaadachi-gun, both of Japan

[73] Assignee: Hosokawa Yoko Co., Ltd., Japan

[21] Appl. No.: 09/128,462

[22] Filed: Aug. 4, 1998

[51] Int. Cl.[7] ..... B31B 1/00

[52] U.S. Cl. ..... 493/11; 493/194; 493/199; 493/227

[58] Field of Search ..... 493/11, 194, 199, 493/223, 227, 230, 234, 241

[56] References Cited

U.S. PATENT DOCUMENTS

| | | | |
|---|---|---|---|
| 4,500,307 | 2/1985 | Bridgeman | 493/230 |
| 5,015,223 | 5/1991 | Boeckmann | 493/194 |
| 5,447,486 | 9/1995 | Anderson et al. | 493/11 |
| 5,660,674 | 8/1997 | Saindon et al. | 493/11 |
| 5,673,534 | 10/1997 | Fowler | 493/194 |
| 5,695,106 | 12/1997 | Bauknecht | 493/11 |
| 5,957,821 | 9/1999 | Scharbrodt et al. | 493/11 |

*Primary Examiner*—Paul N. Dickson
*Assistant Examiner*—Matthew Luby
*Attorney, Agent, or Firm*—Parkhurst & Wendel, L.L.P.

[57] ABSTRACT

A package material processing machine comprises a feeding device for feeding a package material along a predetermined feed course and a processing roller having an outer circumferential surface opposite to the feed course. The package material is processed by rotating the processing roller with feeding the package material along the feed course. In order to process the package material at a desirable pitch with feeding the package material continuously, the machine further comprises a setting device for setting a value correlative with a pitch between a plurality of processed portions on the package material, a feed amount detection device for detecting information correlative with a feed amount of the package material, and a rotation control device for controlling a rotation of the processing roller on the basis of the value set through the setting device and the information detected by the feed amount detection device in such a manner that the plurality of the processed portions are arranged in a feed direction of the package material at the pitch corresponding to the value set through the setting device.

13 Claims, 6 Drawing Sheets

PACKAGE MATERIAL PROCESSING MACHINE

BACKGROUND OF THE INVENTION

1. Field of the Invention

The present invention relates to a package material processing machine capable of processing a package material with feeding the material continuously.

2. Description of the Related Art

There is know a package material processing machine which continuously performs coarse processing or the like on the surface of a package material with feeding the material in a certain direction from a roll thereof and rotating a processing roller provided on a feeding course of the package material.

In the conventional package material processing machine, since the processing means, such as sandpaper, is provided on the whole circumference of the processing roller, it is not possible to process the package material intermittently. If such intermittent processing is required, it is necessary to suspend the material feeding each time when the material is fed in the predetermined amount and to perform processing synchronously with the suspension of the material feeding. However, such an operation disables the continuous material feeding, thereby causing decrease of production efficiency.

SUMMARY OF THE INVENTION

It is an object of the present invention to provide a package material processing machine capable of processing a package material at a desirable pitch with feeding the package material continuously.

In order to attain the above object, a package material processing machine comprising: a feeding device for feeding the package material along a predetermined feed course; a processing roller having an outer circumferential surface opposite to the feed course, the package material being processed by rotating the processing roller with feeding the package material along the feed course; a setting device for setting a value correlative with a pitch between a plurality of processed portions on the package material; a feed amount detection device for detecting information correlative with a feed amount of the package material; and a rotation control device for controlling a rotation of the processing roller on the basis of the value set through the setting device and the information detected by the feed amount detection device in such a manner that the plurality of the processed portions are arranged in a feed direction of the package material at the pitch corresponding to the value set through the setting device.

According to the above processing machine, it is possible to detect timing at which the package material has been fed in the predetermined feed amount corresponding to the value set through the setting device on the basis of the detection result of the feed amount detection device, and also possible to control the rotation of the processing roller in such a manner that a processing portion of the processing roller contacts the package material at that timing. Therefore, it is possible to process the package material at a desirable pitch with feeding the material continuously by repeating the above detection of the timing and the control of the rotation of the processing roller. The pitch of the processed portions on the package material can be modified by changing the rotation speed of the processing roller. Therefore, it is not necessary to exchange the processing roller for changing the pitch.

The package material processing machine of the present invention may further comprise a mark detection device for detecting a registration mark provided on the package material at a specific position in the feed course, and the rotation control device may control the rotation with reference to detection result of the mark detection device so as to keep a certain positional relationship between the registration mark and the plurality of the processed portions in the feed direction. In this case, the package material processing machine may furthermore comprises a speed control device for controlling rotation speed of the processing roller so as to set relative speed between the processing roller and the package material at a contact portion where the processing roller and the package material contact each other to a predetermined value. The speed control device may control the rotation speed of the processing roller to set the relative speed to 0. In this case, since relative displacement between the package material and the processing roller in the feed direction of the package material does not occur at the contact portion thereof, some types of processing in which such relative displacement is not required, such as processing for forming a score or a through hole on the package material, cutting, printing or the like, can be performed.

The processing roller may be provided with an abrasive surface on the outer circumferential surface thereof to form coarse surface portions on the package material. Also, the processing roller may be provided with a cutting edge on the outer circumferential surface thereof to form scores arranged in the feed direction at a desirable pitch. Further, a plurality of cutting edges may be provided on the outer circumferential surface of the processing roller with leaving spaces in an axial direction of the processing roller to form score lines, each of which extends in the axial direction, so as to be arranged in the feed direction at a desirable pitch. In case that width of the cutting edge in an axial direction of the processing roller is greater than that of the package material in the axial direction, it is possible to cut off the package material at a desirable pitch in the feed direction.

The processing roller may be provided with a cone-like projection on the outer circumferential surface thereof to form a plurality of holes arranged in the feed direction at a desirable pitch. A heated portion may be provided on the outer circumferential surface of the processing roller to heat the package material at a desirable pitch in the feed direction.

The processing roller may be provided with a projection on the outer circumferential surface thereof, and a top portion of the projection may curve along a circumferential direction of the processing roller. In this case, the top portion of the projection intermittently contacts the package film in accordance with rotation of the processing roller. Therefore, the type of processing which requires intermittent contact, such as partial coarse surface processing, printing, applying silicone or the like, can readily be performed. The projection may be provided, at least one end portion thereof in the circumferential direction, with a slope portion gradually displacing toward a radially inward side of the processing roller with going away from the top portion in the circumferential direction. In this case, it is possible to change effect of the processing on the package material gradually with using the slope portion.

Still further objects, features and other aspect of the present invention will be understood from the following detailed description of the preferred embodiments of the present invention with reference to the accompanying drawings.

DETAILED DESCRIPTION OF THE PREFERRED EMBODIMENTS

Figure 1:
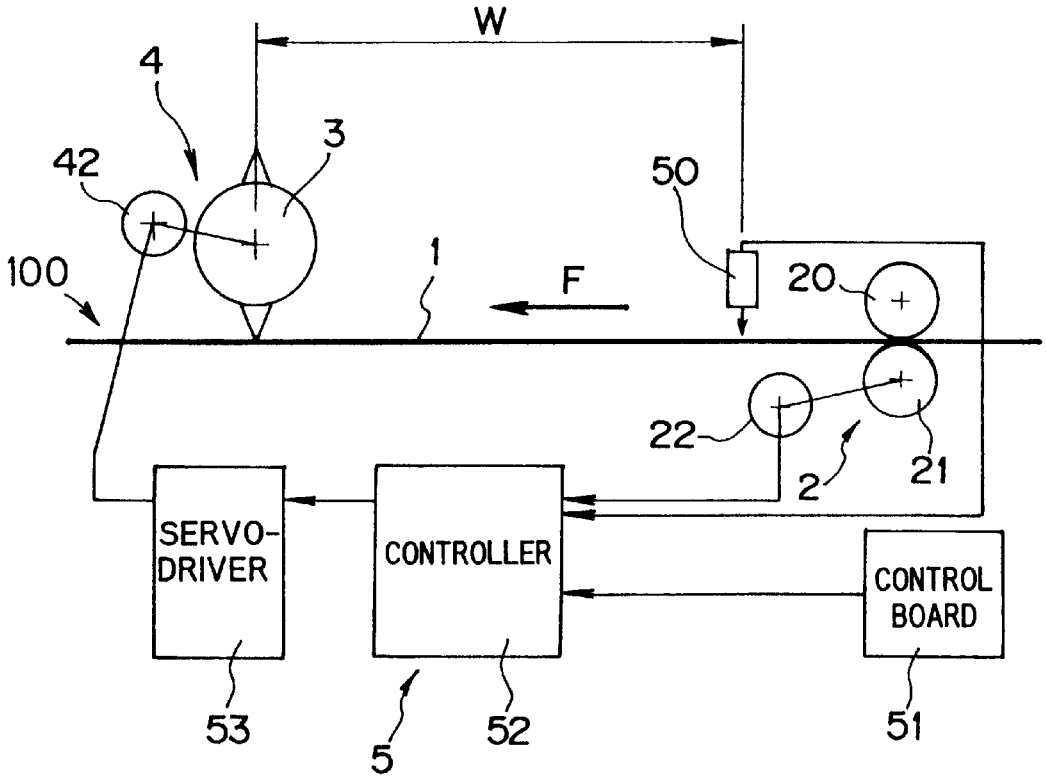
FIG. 1 is a view showing a schematic structure of a package material processing machine in accordance with an embodiment of the present invention.

Now, the preferred embodiments of the present invention will be described below with referring to FIGS. 1–8. As shown in FIG. 1, a package material processing machine of this embodiment comprises a feeding device 2 for feeding a film 1 as a package material in a feed direction indicated by an arrow F, a processing roller 3 disposed over a feeding course 100 of the film 1, a driving device 4 for rotating the processing roller 3, and a control unit 5 for controlling the driving device 4.

Figure 8A:
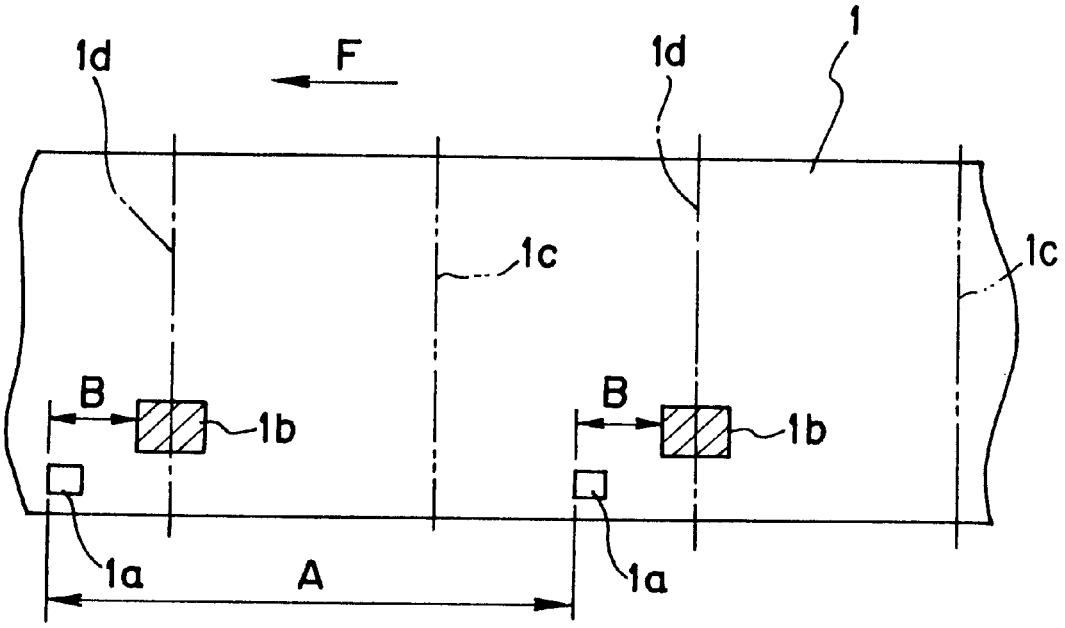
FIG. 8A is a view showing a package material when in the processing.
Figure 8B:
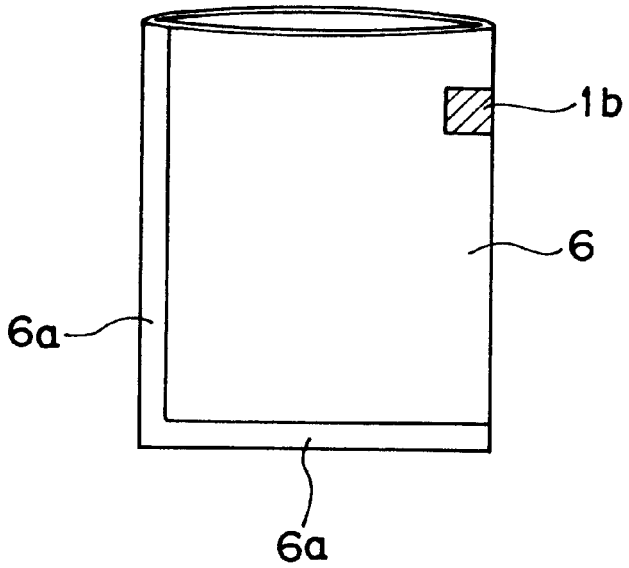
FIG. 8B is a view showing a package produced from the package material.

The film 1 is made of plastic or the like and processed as shown in FIG. 8A. In this example, a plurality of registration marks 1*a*. . . are printed at certain intervals A in a feeding direction indicated by the arrow F, and coarse surface portions 1*b*. . . are processed with leaving certain intervals B from the registration marks 1*a*, respectively. The film 1 is cut off at cutting positions 1*c* . . . , each of which is located in an approximate middle between each coarse surface portions 1*a*, and each cut film 1 is folded along a fold line 1*d* passing the coarse surface portion 1*b* to form a package 6 shown in FIG. 8B. The periphery of the package 6 is sealed by heat sealing portions 6*a*, 6*a*. Each heat sealing portion 6*b* can be formed by various heat seal methods, such as a known seal bar method, an ultrasonic seal method, a high frequency seal method, or the like. In FIG. 8B, the upper end portion of the package 6 still opens, however, this portion will be sealed later. The sealed package 6 can be readily opened by tearing up the coarse surface portion 1*b*. Besides the coarse surface processing, processing for forming a score line or a through hole, printing, a partial silicone coating processing can be performed on the film 1 as necessary. At least part of the above types of processing can be performed by the package material processing machine of this embodiment. The details thereof will be explained later.

Referring to FIG. 1, the feeding device 2 comprises a pair of rollers 20,21. At least one of the rollers 20,21 is driven by a motor (not shown) to feed the film 1 in the above mentioned direction. The roller 21 is connected to a pulse generator 22. The pulse generator 22 generates pulse signals in proportion to the rotation amount of the roller 21 and issues the signals to the control unit 5.

Figure 3:
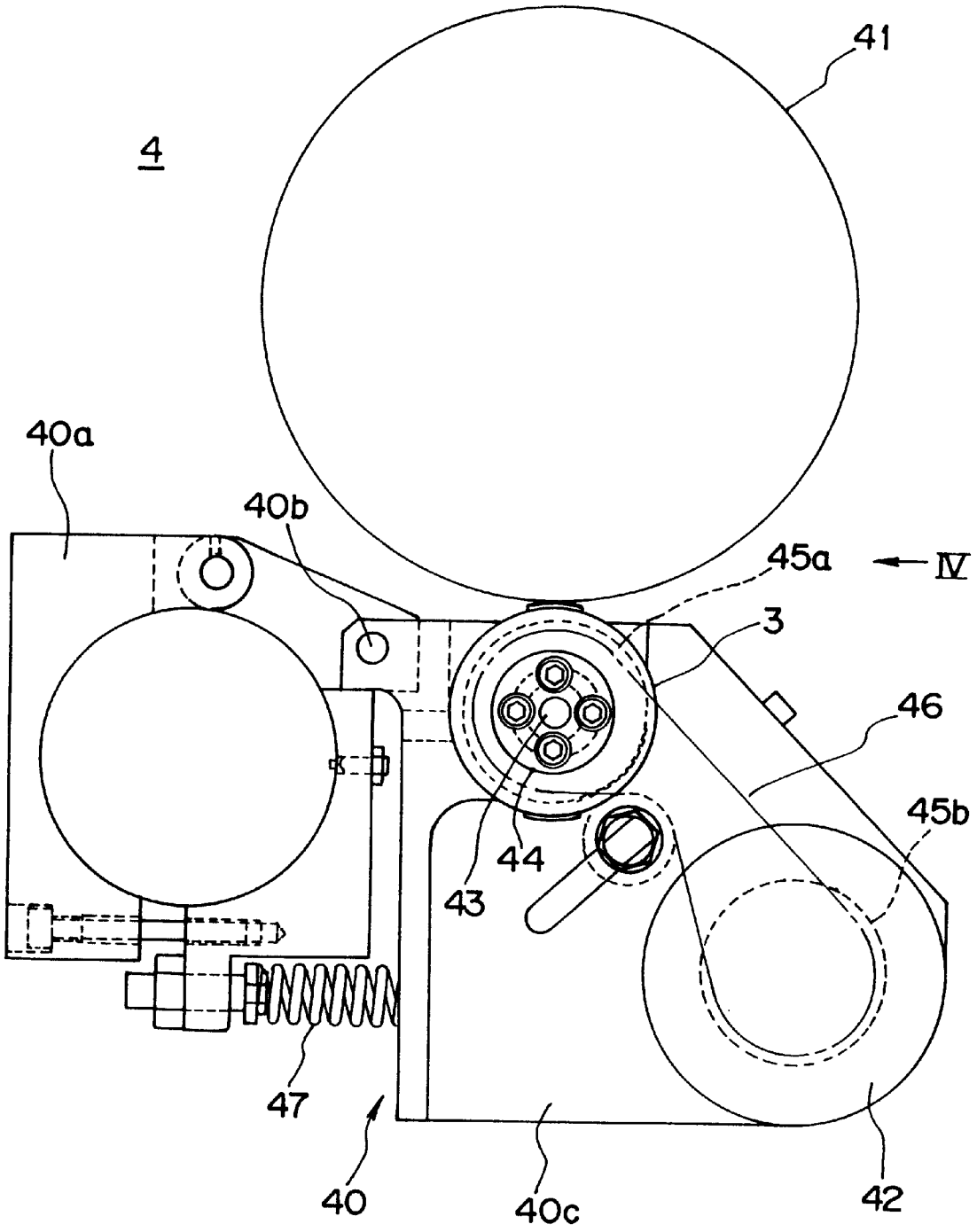
FIG.3 is a view showing details of a processing roller driving device in the package material processing machine of FIG. 1.
Figure 4:
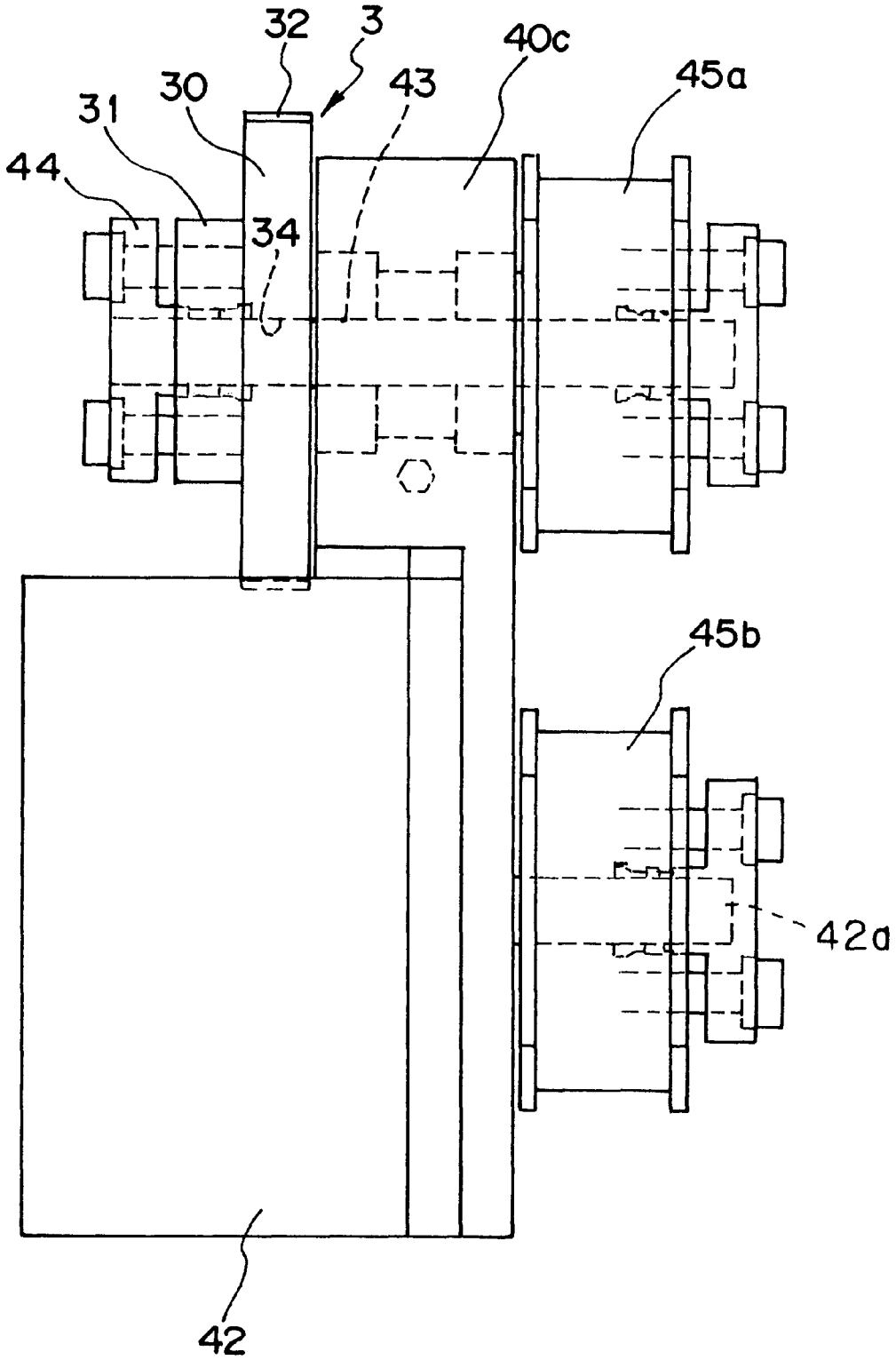
FIG. 4 is a view showing an aspect of the device of FIG. 3 when viewed along an arrow IV illustrated therein.
Figure 5:
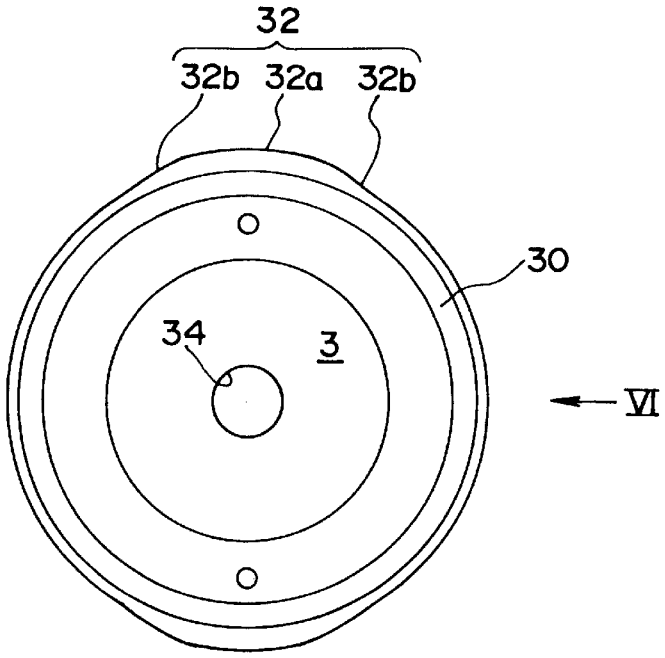
FIG. 5 is a front view of the processing roller of the package material processing machine of FIG. 1.
Figure 6:
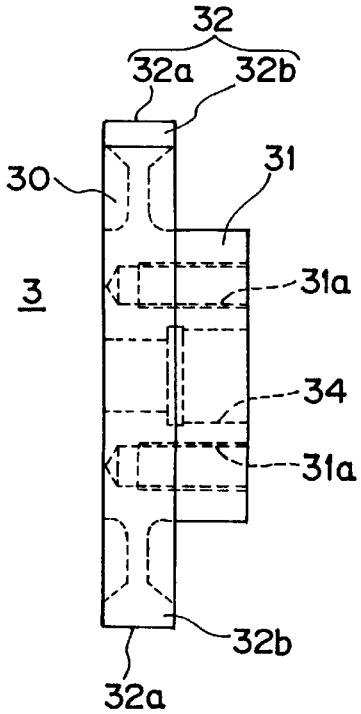
FIG. 6 is a view showing an aspect of the processing roller of FIG. 5 when viewed along an arrow VI illustrated therein.

The processing roller 3 and the driving device 4 are constructed as shown in FIGS. 3–6. As shown in FIGS. 5 and 6, the processing roller 3 comprises a large diameter portion 30 and a small diameter portion 31 coaxial with each other. On the outer circumferential surface of the large diameter portion 30, there is provided a pair of projections 32,32 dividing the processing roller 3 into two equal parts in the circumferential direction thereof. The number of the projections 32 and the configuration thereof can be changed in accordance with the type of the processing performed by the processing roller 3. In FIGS. 5 and 6, a top portion 32*a* of the projection 32 curves cylindrically along the circumferential direction of the processing roller 3 and has slope portions 32*b*, 32*b* at both ends thereof. The outer circumferential portion of the large diameter portion 30 is covered with sandpaper 33. In this case, the coarse surface portion 1*b* can be formed by pressing abrasive surfaces 33*a*, 33*a*, each of which is raised by the projection 32, onto the film 1. FIGS. 7B–7C show modifications of the processing roller 3. The details thereof will be explained later. As shown in FIG. 6, the small diameter portion 31 is provided with screw holes 31*a*. . . to fix the roller 3 to the driving device 4, and an attachment hole 34 is formed at the center of the processing roller 3.

As shown in FIGS. 3 and 4, the driving device 4 comprises a holder 40 supporting the processing roller 3, a cylindrical metal anvil 41 opposite to the processing roller 3, and a servomotor 42 as an actuator of the processing roller 3. The holder 40 comprises a base portion 40*a* secured to a fixed portion of the package material processing machine, e.g. a body of the machine (not shown), and a movable portion 40*c* pivotably connected to the base portion 40*a* through a pin 40*b*. The movable portion 40*c* can be equipped with a shaft 43 rotatable about its axis, and the processing roller 3 is coaxially attached on the shaft 43 through a coupling 44 connected to one end (the left-hand-side in FIG. 4) of the shaft 43.

A pulley 45*a* is fixed at the other end of the shaft 43 and a pulley 45*b* is attached on an output shaft 42*a* of the servomotor 42. Between the pulleys 45*a*, 45*b*, there is stretched a belt 46 to allow transmission of the rotation from the servomotor 42 to the processing roller 3. The anvil 41 is supported by the above mentioned fixed portion of the machine so as to be rotatable about its axis. Between the base portion 40*a* and the movable portion 40*c*, there is provided a coil spring 47 to urge the movable portion 40*c* so as to be swung in the counter clockwise direction in FIG. 3 with the pin 40*b* as a fulcrum. Therefore, the processing roller 3 is pushed toward the outer circumferential surface of the anvil 41. The film 1 is fed between the processing roller 3 and the anvil 41 and is processed by the processing portion, e.g. the abrasive surface 33*a*, provided on the outer circumferential surface of the processing roller 3.

As shown in FIG. 1, the control unit 5 comprises a registration mark sensor 50 as a mark detection device provided on the feeding course of the film 1, a control board 51, a controller 52 and a servo-driver 53. The registration mark sensor 50 detects the registration mark 1*a*(refer to FIG. 8A) on the film 1 and issues predetermined signals to the controller 52. A reflection-type photosensor may be used as the sensor 50. The control board 51 receives setting operation of the operator for setting up a processing condition and issues signals corresponding to the setting operation to the controller 52. The processing condition, which is set through the control board 51, can include value correlative with a pitch between processed portions on the film 1, e.g. the interval B illustrated in FIG. 8A. The controller 52 determines the rotation speed of the servomotor 42 on the basis of the signals issued from both the registration mark sensor 50 and the pulse generator 22 and the signal corresponding to the interval B issued from the control board 51, and then issues a control signal corresponding to the rotation speed to the servo-driver 53. The servo-driver 53 drives the servomotor 42 in accordance with the position and the speed ordered by the controller 52.

Next, the operation of the package material processing machine of this embodiment will be described with referring to the case in which the coarse surface portion 1*b* illustrated in FIG. 8A is formed on the film 1. For preparing the processing of the coarse surface portion 1*b*, the sandpaper 33 is attached on the outer circumferential surface of the processing roller 3, as already explained in FIG. 7A, and the interval B in FIG. 8B is set through the control board 51.

After finishing the above preparation, the film 1 is carried from the right side in FIG. 1 and fed toward the processing roller 3 by the feeding device 2 at a predetermined speed. If a detection signal is issued from the registration mark sensor 50 during the film feeding, the controller 52 determines the drive speed of the servomotor 42 on the basis of the setting value of the interval B and the signal issued from the pulse generator 22 in the following manner.

Namely, if the interval between the position of the registration mark sensor 50 and the processing roller 3 is a predetermined value W, and the feed speed of the film 1 is V/sec., it takes W/V seconds that the registration mark 1*a* reaches the position of the processing roller 3 after it has been detected by the registration mark sensor 50, and it takes B/V seconds that the film 1 is further fed in the interval B. Therefore, if the rotation of the servomotor 42 is controlled in such a manner that the abrasive surface 33*a* contacts the film 1 when (W+B)/V seconds has lapsed after the detection of the registration mark 1*a*, the coarse surface portion 1*b* is formed on the position apart from the registration mark 1*a* at the interval B.

Accordingly, the controller 52 calculates the speed V by differentiating the integrated number of the pulse signals from the pulse generator 22 in time, specifies the interval B on the basis of the signal issued from the control board 51, and calculates the remaining time Tr for starting the processing by the abrasive surface 33*a* using the following expression.

$$Tr=(W+B)/V$$

Note that the value W is given in advance.

After that, the controller 52 determines the drive speed of the servomotor 42 necessary for contacting the abrasive surface 33*a* and the film 1 each other when Tr seconds has lapsed on the basis of the rotation position of the servomotor 42 and the remaining time Tr and then orders the drive speed to the servo-driver 53.

The current position of the servomotor 42 can be specified by detecting the rotation amount of the servomotor 42 using an encoder or the like. If the servomotor 42 is controlled so as to stop at a predetermined reference position after finishing the coarse surface processing corresponding to the detection of one registration mark 1*a* to prepare the next processing, it is not necessary to detect the current rotation position of the servomotor 42. The drive speed of the servomotor 42 may be properly corrected by comparing the number of the pulse signals of the pulse generator 22 and the rotation amount of the servomotor 42 detected by an encoder or the like between the detection of the registration mark 1*a* and the start of the processing.

In case that the rotation movement of the servomotor 42 is controlled as mentioned above, the abrasive surface 33*a* contacts the film 1 at the position apart from the registration mark 1*a* at the interval B and the coarse surface portion 1*b* is formed in accordance with the setting thereof. Since the slope portions 32*b* are provided at both ends of the projection 32, the effect of the coarse surface processing decreases at both ends of the coarse surface portion 1*b* as the distance from the center of the coarse surface portion 1*b* increases.

Figure 2A:
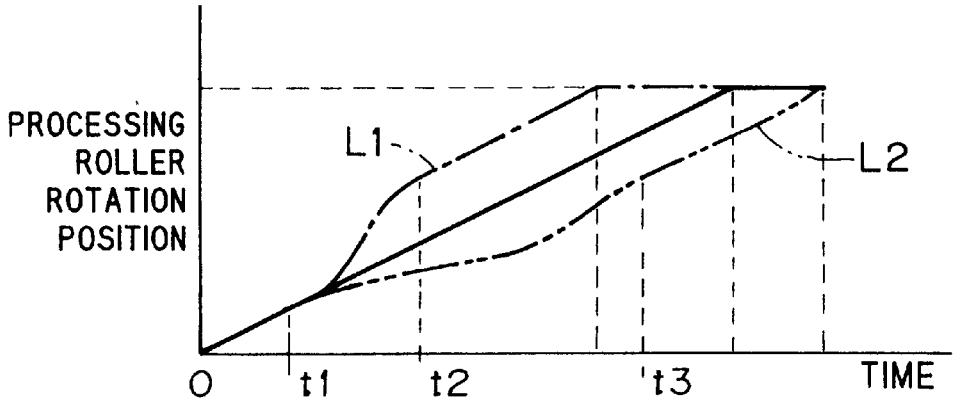
FIG. 2A is a diagram showing a relationship between time and a rotation position of a processing roller controlled by a controller of FIG. 1.
Figure 2B:
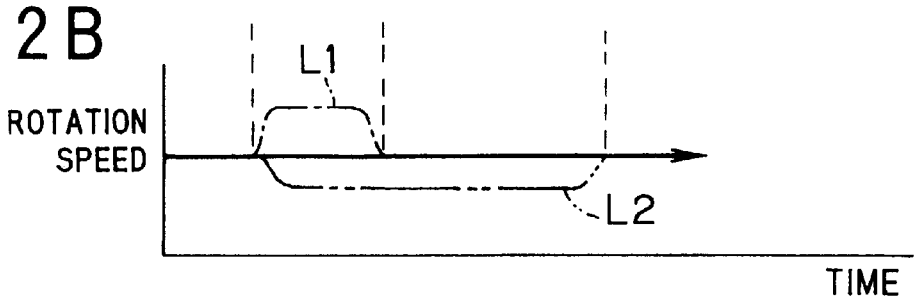
FIG. 2B is a diagram showing a relationship between time and a rotation speed of the processing roller controlled by the controller of FIG. 1.

In the above control process, if there is a fear that the speeds of the processing roller 3 and the film 1 do not accord with each other and the coarse surface portion 1*b* is excessively scraped due to the relative displacement between the processing roller 3 and the film 1, it is preferable to adjust the rotation speed of the servomotor 42 in such a manner that the speeds of the abrasive surface 33*a* in a tangential direction thereof and the film 1 accord with each other when the abrasive surface 33*a* starts to contact the film 1. FIGS.2A and 2B show examples of the relationship between time and the rotation position or the rotation speed of the processing roller 3 when such control of the servomotor 42 is performed. In these examples, the registration mark 1*a* is detected at the origin in FIG. 2A, and the processing roller 3 is driven so as to start the coarse processing at the time t1. If the relative speed between the film 1 and the abrasive surface 33*a* is 0 at the time t1, the rotation speed of the processing roller 3 is fixed as indicated by solid lines in FIGS. 2A and 2B. On the contrary thereto, if the speed of the abrasive surface 33*a* is slower than that of the film 1, the speed of the processing roller 3 is increased as indicated by chain lines L1, and in the reverse case in which the speed of the abrasive surface 33*a* is faster than that of the film 1, the speed of the processing roller 3 is decreased as indicated by two-dot chain lines L2. After processing finish time t2 or t3, the speed of the processing roller 3 is returned to the former value before the time t1. The processing roller 3 stops for preparing the next processing after rotating to the predetermined position.

In the above embodiment, the control board 51 works as a setting device, the pulse generator 22 works as a feed amount detection device, and the controller 52 works as a rotation control device and a speed control device.

In the above embodiment, the partial coarse surface processing is performed by attaching the sandpaper 33 on the outer circumferential surface of the processing roller 3, however, the present invention is not limited to such embodiment. For example, it may be possible to apply silicone partially on the film 1 using the top portion of the projection 32, or to perform printing partially.

Figure 7A:
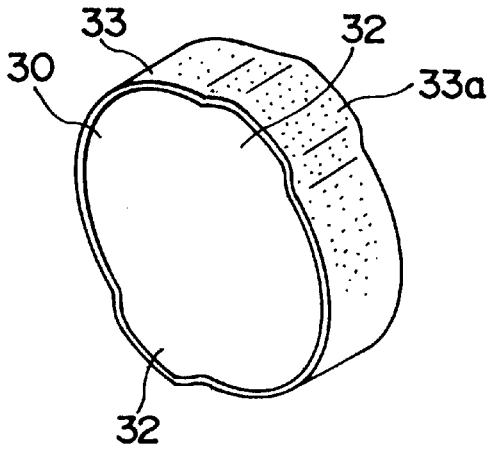
FIGS. 7A–7E are perspective views showing variations of the processing roller.
Figure 7B:
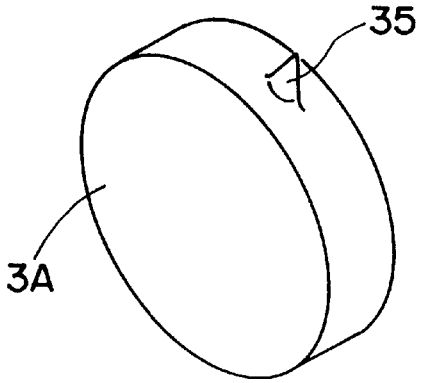
Figure 7C:
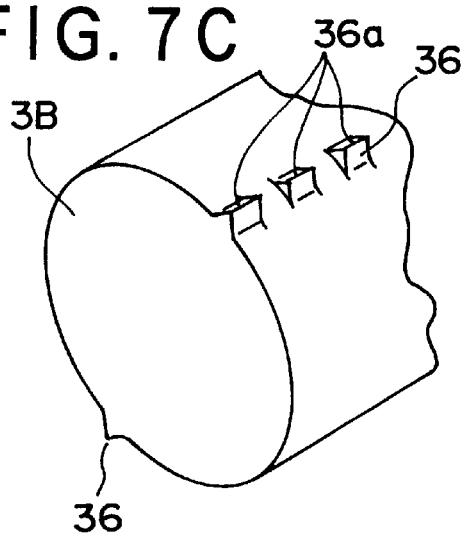

Also, it may be possible to attach one of rollers illustrated in FIGS. 7B–7E to the machine instead of the roller 3 of FIG. 7A.

The processing roller 3A of FIG. 7B is equipped with a cone-like projection 35 on the outer circumferential surface thereof. This processing roller 3A allows the machine to perforate the film 1 at a desirable pitch by piercing the film 1 with the projection 35.

The processing roller 3B of FIG. 7C is equipped on the outer circumferential surface thereof with a plurality of projections 36 . . . arranged in the axial direction of the roller 3B with leaving spaces therebetween and each having a generally triangular sectional configuration, and a cutting edge 36*a* is formed at a ridge portion of each projection 36. This processing roller 3B allows the machine to form a score line on the film 1 by using each cutting edge 36*a*.

Figure 7D:
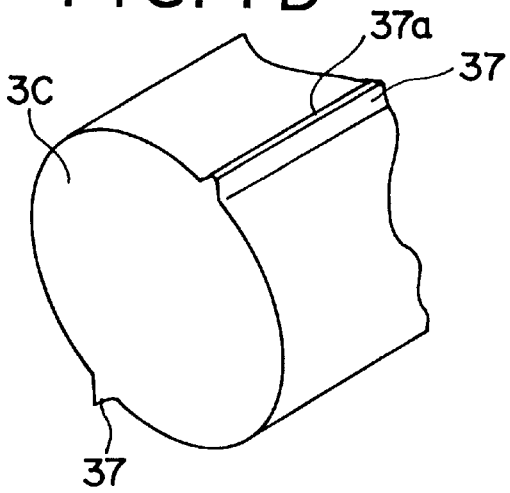

The processing roller 3C of FIG. 7D is equipped on the outer circumferential surface thereof with projections 37, 37 each having a generally triangular sectional configuration and extending over generally full length of the roller 3C in its axial direction, and a cutting edge 37*a* is formed at a ridge portion of each projection 37. This processing roller 3C allows the machine to cut off the film 1 at a desirable pitch by setting the width of the cutting edge 36*a* at a value greater than that of the film 1 in the axial direction of the roller 3C.

Figure 7E:
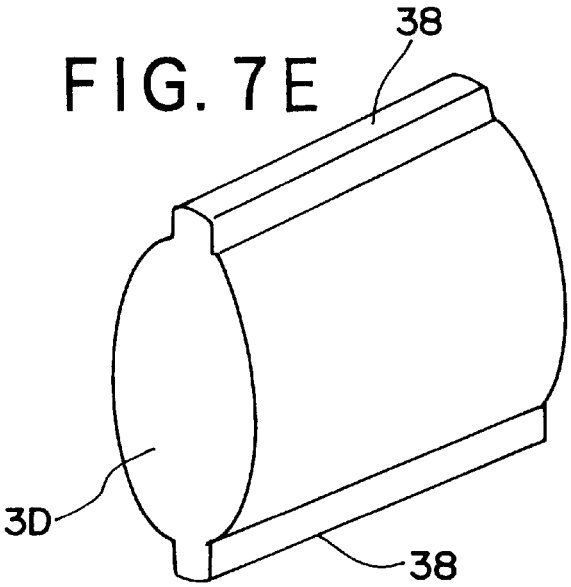

The processing roller 3D of FIG. 7E is equipped on the outer circumferential surface thereof with projections 38, 38 each extending in the axial direction of the roller 3D and apart from each other in the circumferential direction of the roller 3D with a suitable interval, and each projection 38 is capable of being heated by heating means, such as an electrical heater (not shown). This processing roller 3D allows the machine to perform heat sealing on the film 1 at a desirable pitch. Note that the heat sealing can partially be performed by heating the projection 32 of FIG. 7A.

The relative speed between the processing roller 3 and the film 1 at a position where both of them contact each other is not limited to 0, it may be changed to suitable value in accordance with necessity. In the above embodiment, the coarse surface portion 1*b* is apart from the registration mark 1*a* at a predetermined interval, however, the present invention can be applied to a case of forming the processed portions, such as coarse surface portions, on the film 1 at a desirable pitch without using the reference point, such as registration mark 1*a*. In this case, it can be possible to omit the registration mark sensor 50. In case that the feed speed of the package material is set at a fixed value, it can be possible to estimate the feed amount of the package material by detecting the setting value of the feed speed without calculating the actual speed by using the pulse generator or the like. The package made of the package material is not limited to the embodiment of FIG. 8B, and various modification may be applied to the package. The process for forming the coarse surface portion on the package material, for example made of an oriented plastic film, can independently be performed from the other process, however, it can be possible to perform the process for forming the coarse surface portion and the other process, such as a printing process or a laminating process at the generally same time by integrating these processes into a continuous line to form an in-line process.

What is claimed is:

1. A package material processing machine comprising:

a feeding device for feeding package material along a predetermined feed course;

a processing roller having an outer circumferential surface touching the feed course, the outer circumferential surface having at least one projection, for processing package material being processed by rotating the processing roller while feeding package material along the feed course to cause said at least one projection to be brought into contact with package material;

a setting device for setting a value correlative with a pitch between a plurality of portions to be processed on package material;

a feed amount detection device for detecting information correlative with a feed amount of package material; and a rotation control device for controlling a rotation speed of the processing roller on the basis of the value set through the setting device and information detected by the feed amount detection device in such a manner that processed portions are arranged in a feed direction of package material at the pitch corresponding to the value set through the setting device.

2. The package material processing machine according to claim 1, further comprising a mark detection device for detecting a registration mark provided on the package material at a specific position in the feed course, wherein an interval between the registration mark and the processed portion is set through the setting device, and the rotation control device controls the rotation speed with reference to a detection result of the mark detection device and the interval set through the setting device for keeping the interval between the registration mark and the processed portion in the feed direction.

3. The package material processing machine according to claim 2, further comprising a speed control device for controlling rotation speed of the processing roller to set relative speed between the processing roller and package material at a contact portion where said at least one projection of the processing roller and package material contact each other at a predetermined value.

4. The package material processing machine according to claim 3, wherein the speed control device controls the rotation speed of the processing roller to set the relative speed between the processing roller and package material at 0.

5. The package material processing machine according to claim 1, wherein an abrasive surface is provide on said at least one projection of the processing roller.

6. The package material processing machine according to claim 1, wherein a cutting edge is provided on said at least one projection of the processing roller.

7. The package material processing machine according to claim 1, wherein a plurality of projections are provided on the outer circumferential surface of the processing roller with spaces therebetween in an axial direction of the processing roller and there is a cutting edge on each of the projections.

8. The package material processing machine according to claim 6, wherein a width of the cutting edge in an axial direction of the processing roller is greater than a width of the package material in the axial direction.

9. The package material processing machine according to claim 1, wherein said at least one projection comprises a cone-like projection on the outer circumferential surface of the processing roller.

10. The package material processing machine according to claim 1, wherein a heated portion is provided on said at least one projection of the processing roller.

11. The package material processing machine according to claim 1, wherein a top portion of said at least one projection curves along a circumferential direction of the processing roller.

12. The package material processing machine according to claim 11, wherein a slope portion gradually displaced towards a radially inward side of the processing roller while moving away from the top portion in the circumferential direction thereof is provided on at least one end portion of said at least one projection in the circumferential direction.

13. The package material processing machine according to claim 1, wherein the setting device comprises means for receiving the value correlative with the pitch, and issuing signals corresponding to the value to the rotation control device.

* * * * *